United States Patent [19]

Nakahara et al.

[11] Patent Number: 4,978,597

[45] Date of Patent: Dec. 18, 1990

[54] IMAGE FORMING METHOD AND IMAGE FORMING APPARATUS UTILIZING A TONER-CARRYING MEMBER WITH SPHERICAL CONCAVITIES

[75] Inventors: Toshiaki Nakahara, Tokyo; Hirohide Tanikawa, Yokohama, both of Japan

[73] Assignee: Canon Kabushiki Kaisha, Tokyo, Japan

[21] Appl. No.: 316,802

[22] Filed: Feb. 28, 1989

[30] Foreign Application Priority Data

Feb. 29, 1988 [JP] Japan ..... 63-046882

[51] Int. Cl.[5] ..... G03G 15/08

[52] U.S. Cl. ..... 430/122; 355/252

[58] Field of Search ..... 430/102, 120, 122; 355/252

[56] References Cited

U.S. PATENT DOCUMENTS

| | | | |
|---|---|---|---|
| 3,914,460 | 10/1975 | Maksymiak | 430/120 |
| 4,289,837 | 9/1981 | Gundlach | 430/120 |
| 4,377,332 | 3/1983 | Tamura | 355/3 DD |
| 4,380,966 | 4/1983 | Isaka et al. | 118/651 |
| 4,822,711 | 4/1989 | Itaya et al. | 430/120 |

FOREIGN PATENT DOCUMENTS

| | | |
|---|---|---|
| 2755890 | 6/1979 | Fed. Rep. of Germany . |
| 3014849 | 11/1980 | Fed. Rep. of Germany . |

OTHER PUBLICATIONS

Abstract 60-57859, Masuo Yamazaki, Magnetic Microcapsule Toner, Aug. 7, 1985, vol. 9, No. 190 (P-378)[1913].

Abstract 58-11974, Masaaki Sakura, Developing Device, Apr. 6, 1983, vol. 7, No. 82 (P-189)[1227].

Abstract 62-143075, Hidenobu Yamane, Developing Device, Dec. 5, 1987, vol. 11, No. 373 (P-643)[2820].

*Primary Examiner*—John L. Goodrow

*Attorney, Agent, or Firm*—Fitzpatrick, Cella, Harper & Scinto

[57] ABSTRACT

An image forming apparatus, comprises an electrostatic image-bearing member for holding an electrostatic charge image and a toner-carrying member having a surface for carrying a magnetic toner thereon, wherein the surface of the toner-carrying member has an unevenness comprising sphere-traced concavities formed by blasting with particles with a definite spherical shape; the magnetic toner comprisaes 17-60% by number of particles of 5 microns or smaller, 1-23% by number of particles of 8-12.7 microns, and 2.0% by volume or less of particles of 16 microns or larger and has a volume-average particle size of 4-11 microns; the electrostatic image-bearing member and the toner-carrying member are disposed with a prescribed gap therebetween at a developing station; means for forming a magnetic toner layer on the toner-carrying member in a thickness which is thinner than the prescribed gap; and means for applying an alternating electric field for development with the magnetic toner at the developing station. The surface of the toner-carrying member comprising the sphere-traced concavities allows the forming of a uniform thin toner layer thereon when combined with the magnetic toner having a specific particle size distribution while the soiling of the surface is prevented for a long period of use.

45 Claims, 4 Drawing Sheets

IMAGE FORMING METHOD AND IMAGE FORMING APPARATUS UTILIZING A TONER-CARRYING MEMBER WITH SPHERICAL CONCAVITIES

FIELD OF THE INVENTION AND RELATED ART

The present invention relates to an image forming method including a step of developing an electrostatic charge image formed in electrophotography, electrostatic printing, electrostatic recording, etc., and an image forming apparatus therefor.

Hitherto, as a developing method using a one component magnetic toner, there has been known a developing method using an electroconductive magnetic toner as disclosed in U.S. Pat. No. 3,909,258. In such a developing method, however, the toner is essentially required to be electroconductive, and when such an electroconductive toner is used, it has been difficult to transfer a toner image formed on a latent image-bearing member to a final image supporting member such as plain paper by use of an electric field.

A novel developing method capable of solving such a problem encountered in a developing method using a one-component electroconductive magnetic toner, has been proposed in U.S. Pat. Nos. 4,395,476 and 4,292,387. In this developing method, an insulating magnetic toner is uniformly applied on a cylindrical toner-carrying member containing inside therein a magnet, and the toner is disposed to face without contact a latent image-holding member to be used for developing. In a method of forming a toner layer on a toner-carrying member, a coating blade is used at the exit of a toner container. FIG. 3 shows an example of such an apparatus. At a position opposite to a magnetic pole N1 of a fixed magnet 304 disposed inside a toner-carrying member 302, a blade 301*a* composed of a magnetic material is disposed to form ears or brush hairs of a toner the magnetic flux formed between the magnetic pole and the magnetic blade. The toner ears are cut by the tip edge of the blade, thus regulating the toner layer thickness by utilizing a magnetic force function as disclosed in U.S. Pat. Nos. 4,386,577, 4,387,664, 4,458,627, and 4,421,057.

It is possible to achieve good developing free from fog, with excellent reproduction of gradation, and free from thinning of the image edge by applying a low frequency alternating voltage between the toner-carrying member and the conductive substrate of the latent image-holding member at the time of developing. This will cause reciprocal movement of the toner between the toner-carrying member and the latent image-holding member. According to this developing method, the toner is insulating so that electrostatic transfer is easily performed.

The apparatus shown in FIG. 3 includes a toner container 307 for containing toner 310, and a latent image-holding member (hereinafter called a "photosensitive member" or "photosensitive drum") 309 such as a photosensitive drum for electrophotography or an insulating drum for use in electrostatic recording.

Such a developing method involves requirements as follows. Requirement (A) of uniformly coating a magnetic toner on a toner-carrying member and requirement (B) of preventing or minimizing the soiling of the toner-carrying member with components in the magnetic toner. The requirements (A) and (B) are however contradictory with each other, and it is difficult to satisfy the both requirements at the same time.

For requirement (A), a method of uniformly coating a toner-carrying member with a magnetic toner has been proposed in U.S. Pat. No. 4,380,966. In this method, a toner-carrying member, as shown in FIG. 3, having an indefinite-shaped uneven surface formed by sand-blasting using indefinite-shaped particles is used, whereby it is possible to maintain a good toner coating condition which is even, uniform and free from irregularity on the toner-carrying member surface continually for a long period of time. On the surface of the toner-carrying member, an enormous number of fine cuttings and projections are formed in random directions on the stainless steel cylinder as shown in FIG. 4 which is a photograph through a scanning electron microscope at a magnification of 2000.

However, in a developing apparatus using a toner-carrying member having such a specific surface state, the toner or the component thereof is liable to attach to the surface depending on the magnetic toner used and would result in soiling of the toner-carrying member surface. As a result, as the initial image causes a lowering in image density and the soiling proceeds in a successive operation, white dropout of the image is liable to occur at a rotation cycle of the toner-carrying member. This is because some toner particles attach to the side slopes of convexities and concavities on the surface of the toner-carrying member, so that the magnetic toner particles are insufficiently charged to lower the electric charge of the toner layer. A state of soiling of a toner-carrying member surface with toner components is shown in FIG. 5 which is a scanning electron microscope photograph at a magnification of 2000.

In general, a magnetic toner comprises components such as a binder resin, a magnetic material, a charge controlling agent, and a releasing agent. Therefore, in order to prevent the soiling of a toner-carrying member surface, the selection of materials has been restricted.

With respect to the requirement (B) of preventing or minimizing the soiling of the magnetic toner-carrying member, it may be assumed to use a smoother surface of a toner-carrying member. In this case, however, the toner coating is liable to be ununiform when the magnetic toner has a volume-average article size of 12 microns or larger. Irregularities are found in developed images, so that a good image cannot be expected. When such a toner coating irregularity was examined in detail during blank rotation of a developing apparatus, the following effects were observed.

While the cause has not been clarified as yet, in the initial stage of blank rotation, the toner coating layer became excessively thick and, when the toner-carrying member surface was smooth and the toner thickness was regulated gradually by a blade 301*a*, the toner was forced out to form a toner stagnation 310*a* at part A as shown in an enlarged sectional view of FIG. 6. Then, when the toner stagnation reached a certain limiting amount, it was compelled by the conveying force of the sleeve 302 to be transferred to the sleeve, thus forming a coating irregularity or clog 303*a*. When such toner clogs 303*a* appear on the coated toner layer 303, they lead to irregularities on the image and the irregularities are observed as thick density irregularities or irregular fog. The toner coating irregularities 303*a* appear in various shapes such as rectangular spots, waveform spots and waveform patterns. As described above, in the conventional developing methods, it has been extremely difficult to satisfy both the requirements (A) and (B) in combination.

SUMMARY OF THE INVENTION

An object of the invention is to provide an image forming method and an image forming apparatus wherein a magnetic toner is uniformly applied on a toner-carrying member and soiling of the toner-carrying member surface with magnetic toner and/or a component thereof is prevented or minimized for a long period of time.

A further object of the present invention is to provide an image forming method and an image forming apparatus which provide clear high quality images which have a high density, are excellent in reproducibility of thin lines and gradation and are free from fog for a long period.

According to the invention, there is provided an image forming method, comprising: disposing an electrostatic image-bearing member for holding an electrostatic charge image and a toner-carrying member for carrying a magnetic toner with a prescribed gap therebetween at a developing station, wherein the surface of the toner-carrying member has an unevenness comprising sphere-traced concavities formed by blasting with particles with a definite spherical shape; the magnetic toner comprises 17–60% by number of particles of 5 microns or smaller, 1–23% by number of particles of 8–12.7 microns, and 2.0% by volume or less of particles of 16 microns or larger and has a volume-average particle size of 4–11 microns;

conveying the magnetic toner in a layer regulated in a thickness thinner than the prescribed gap to the developing station; and applying an alternating electric field to the toner-carrying member at the developing station to effect development with the magnetic toner.

According to another aspect of the present invention, there is provided an image forming apparatus, comprising: an electrostatic image-bearing member for holding an electrostatic charge image and a toner-carrying member having a surface for carrying a magnetic toner thereon, wherein the surface of the toner-carrying member has an unevenness comprising sphere-traced concavities formed by blasting with particles with a definite spherical shape; the magnetic toner comprises 17–60% by number of particles of 5 microns or smaller, 1–23% by number of particles of 8–12.7 microns, and 16 microns or larger and 2.0% by volume or less of particles of has a volume-average particle size of 4–11 microns; the electrostatic image-bearing member and the toner-carrying member are disposed with a prescribed gap therebetween at a developing station;

means for forming a magnetic toner layer on the toner-carrying member in a thickness which is thinner than the prescribed gap; and means for applying an alternating electric field for development with the magnetic toner at the developing station.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
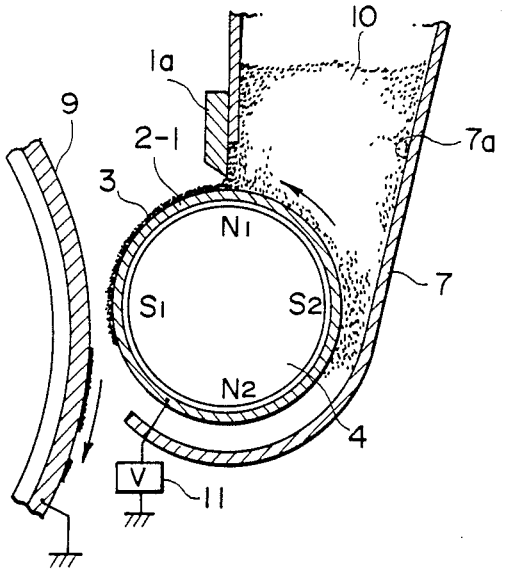
FIG. 1 is a schematic illustration of a developing apparatus according to the present invention.
Figure 3:
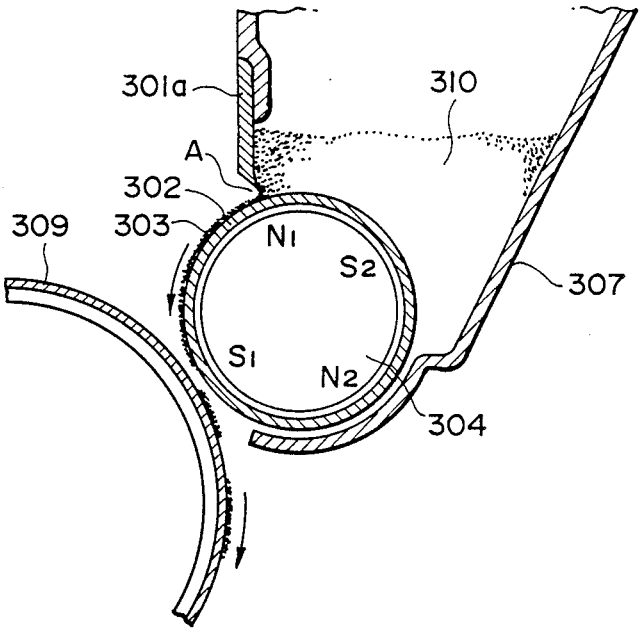
FIG. 3 is a sectional view of a developing apparatus using a magnetic blade.

In the present invention, the surface of the toner-carrying member is provided with a specific unevenness pattern comprising sphere- or globule-traced concavities, so that toner components do not readily adhere to the surface and soiling is prevented or minimized for a long period of time. Compared with a toner-carrying member having an uneven surface comprising an enormous number of fine cuttings or projections formed by sand-blasting with indefinite shaped particles, the toner-carrying member of the present invention is much better in remaining free from the soiling of the surface. On the other hand, compared with a toner-carrying member having a completely smooth surface, the toner-carrying member of the present invention has a better function of uniformly coating a magnetic toner on the toner-carrying member.

The magnetic toner used in the present invention has a volume-average particle size of 4 to 11 microns and a specific particle size distribution, so that the toner coating layer is prevented from becoming excessively thick even if the toner-carrying member of the present invention is used, whereby a uniform toner coating layer is formed without causing toner coating irregularities for a long period of use. As a result, it is possible to obtain clear and high quality images which are excellent in reproducibility of thin lines and gradation and free from fog.

Hereinbelow, the present invention will be explained in more detail. In the following description, the toner-carrying member is called a "sleeve".

The sleeve of the present invention has an uneven surface comprising sphere-traced concavities. The surface state can be obtained by blasting with definite-shaped particles. Herein, the definite-shaped particles may preferably be spherical or spheroidal particles having a substantially smoothly curved surface and having a ratio of longer axis/shorter axis of 1–2, preferably 1–1.5, more preferably 1–1.2. The definite-shaped particles may for example be various solid spheres or globules mode of metals such as stainless steel, aluminum, steel, nickel and bronze, or ceramic plastic or glass beads, respectively, having a specific particle size. By blasting the sleeve surface with such definite-shaped particles having a specific particle size, it is possible to form a plurality of sphere-traced concavities having almost the same diameter R.

In the present invention, the plurality of sphere-traced concavities on the sleeve surface may preferably have a diameter R of 20 to 250 microns. If the diameter R is smaller than 20 microns, the soiling potential with a magnetic toner component will increase. On the other hand, a diameter R of over 250 microns is not preferred because the uniformity of toner coating on the sleeve will decrease. As a result, the definite-shaped particles used in blasting of the sleeve surface should preferably have a diameter of 20–250 microns. The definite shaped particles can have a particle size distribution as long as the above-mentioned diameter R and the pitch P and roughness d of the sleeve surface as described hereinbelow are satisfied.

In the present invention, the pitch P and the surface roughness d of the unevenness of a sleeve surface are based on measured values of roughness of the sleeve obtained by using a micro-surface roughness meter (commercially available from, e.g., Taylor-Hopson Co., and Kosaka Kenkyusho K.K.), and the surface roughness d is expressed in terms of a 10 point-average roughness (Rz) (JIS B 0601).

Figure 7:
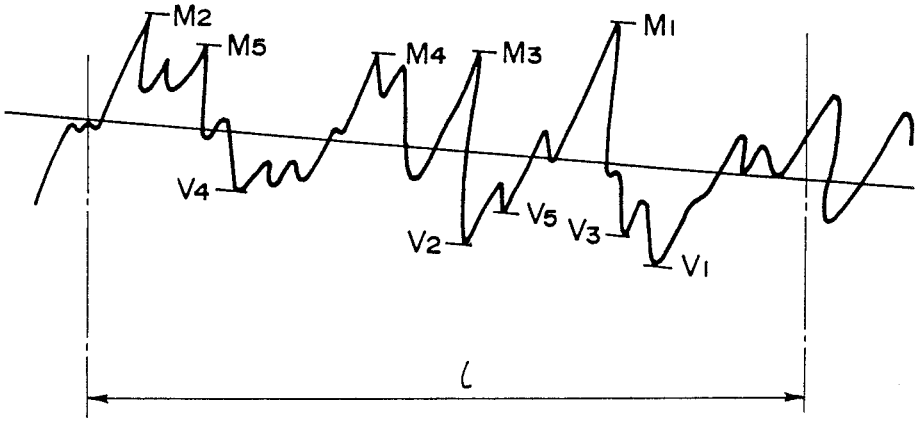
FIG. 7 is an illustration for defining surface roughness and pitch.

More specifically, FIG. 7 shows an example of a surface section curve, from which a portion with a standard length 1 is taken. In the portion, an average line is drawn as shown in FIG. 7, and then two lines each parallel with the average line are drawn one passing through a third highest peak ($M_3$) and the other passing through a third deepest valley or bottom ($V_3$). The 10 point-average roughness ($R_z$ or d) is measured as the distance between the two lines in the unit of microns (micro-meters), and the standard length 1 is taken as 0.25 mm. The pitch P is obtained by counting the number of peaks having a height of 0.1 micron or higher with respect to the bottoms on both sides thereof and defined as follows: P=250 (microns)/(the number (n) of the peaks in the length of 250 (microns)).

In the present invention, the pitch P of the roughness on the sleeve surface may preferably be 2 to 100 microns. A pitch P of less than 2 microns is not preferred because the soiling potential of the sleeve with toner component is increased. On the other hand, a pitch P in excess of 100 microns is not preferred because the uniformity of toner coating on the sleeve will decrease. The surface roughness d of the sleeve surface may preferably be 0.1 to 5 microns. A roughness d in excess of 5 microns is not preferred because an electric field is liable to be concentrated at uneven portions to cause disturbance in images in a system wherein an alternating voltage is applied between the sleeve and the latent image-holding member to cause jumping of the magnetic toner from the sleeve side onto the latent image surface. On the other hand, a roughness d of less than 0.1 micron is not preferred because the uniformity of toner coating on the sleeve will decrease.

Figure 2:
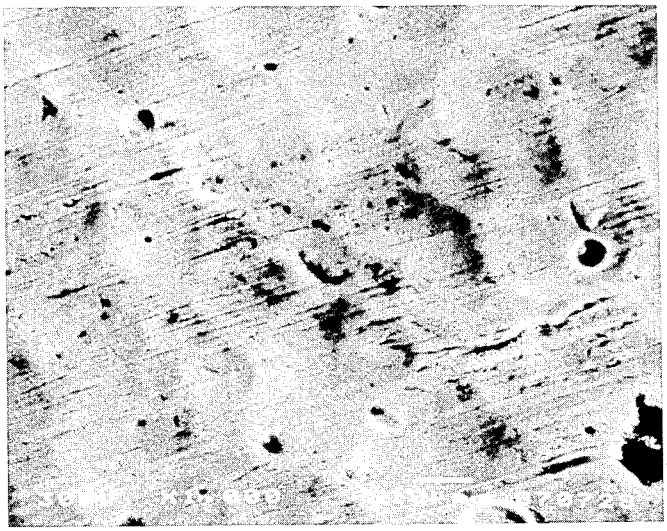
FIG. 2 is a photograph taken through a scanning electron microscope of the surface metallic structure of a sleeve blasted with definite-shaped particles according to the present invention.
Figure 4:
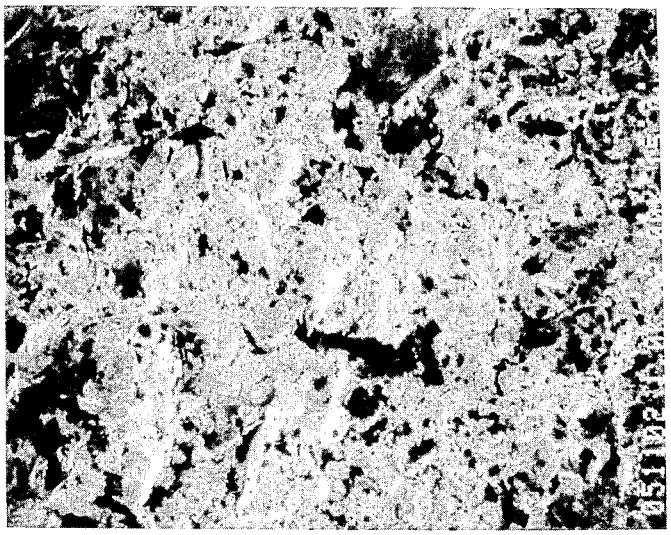
FIG. 4 is a scanning electron microscopic photograph of the surface metallic texture of a sleeve sand-blasted with indefinite-shaped particles.
Figure 5:
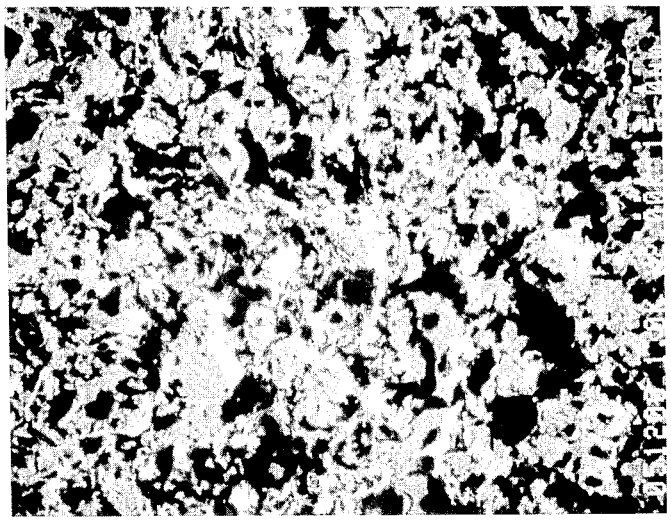
FIG. 5 is an electron microscopic photograph of the surface metallic texture of a sleeve sand-blasted with indefinite-shaped particles and soiled with magnetic toner components during development.

An example of the sleeve used in the present invention may be one of stainless steel, the surface of which having been blasted with glass beads including 80% by number of beads having a diameter of 53 to 62 microns. FIG. 2 is a scanning electron microscopic photograph at a magnification of 1000 of such a sleeve surface.

Figure 6:
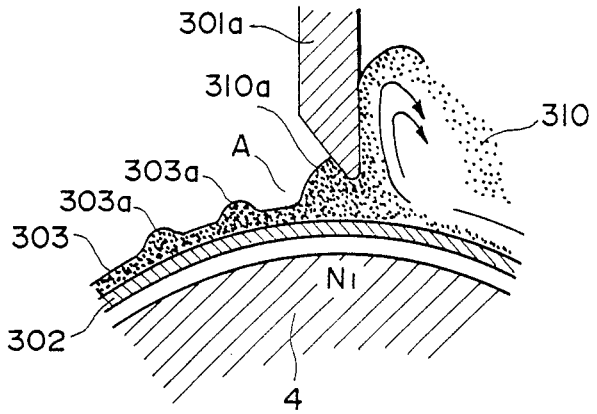
FIG. 6 is an illustration of toner coating irregularities.

One characteristic feature of the magnetic toner used in the present invention is that it has a volume-average diameter of 4 to 11 microns. The sleeve of the present invention (hereinafter called the instant sleeve 2-1) has a specific uneven surface comprising a plurality of sphere-traced concavities. The sleeve has been found to show a slightly lower performance in respect of uniformly coating the sleeve with a magnetic toner when a toner having a volume average particle size of larger than 12 microns is used in a specific environmental condition, compared with a sleeve (hereinafter called the comparative sleeve 302) having an uneven surface formed by sand-blasting with indefinite-shaped particles. More specifically, when a magnetic toner having a volume-average particle size of over 12 microns was used under the environmental conditions of a temperature of below 15° C. and a humidity of below 10% and the toner was subjected to blank rotation in two developing apparatuses, one having the instant sleeve 2-1 and the other having the comparative sleeve 302, the toner layer weight M/S per unit area of the sleeve was found to be 1.6 to 2.3 mg/cm$^2$ for the instant sleeve 2-1 and 0.6 to 1.5 mg/cm$^2$ for the comparative sleeve 302. Thus, the sleeve 2-1 provided a thicker toner coating layer, and on further blank rotation for a long period, was found to cause toner coating irregularities as shown in FIG. 6 in some cases. As a result of further investigation of ours, however, while the reason has not been clarified as yet, when similar experiments were performed by using a magnetic toner having a volume-average particle size of 4 to 11 microns, even the instant sleeve 2-1 was found to provide a thin toner coating thickness at M/S of 0.7–1.5 mg/cm$^2$ without coating irregularities on the sleeve even on further continuation of blank rotation or a long period, and the decrease in toner coating thickness was found to be very effective in uniformization of toner coating for a long period.

In the present invention, the magnetic toner may preferably have a volume-average particle size of 4–11 microns, particularly 6–10 microns. A volume-average particle size of below 4 microns is liable to provide a small toner coverage on transfer paper in case of a high image area proportion such as in graphic images, thus resulting in a low image density. A volume average particle size in excess of 12 microns decreases the effect of uniformization of sleeve coating.

In the present invention, the charge and the weight of a toner layer on unit area of the toner-carrying member were measured by the so-called Faraday cage method. In the suction-type Faraday cage method, the outer cylinder thereof is pushed against a toner-carrying member to suck all the toner on a prescribed area of the carrying member and collect the toner in the filter in the inner cylinder, whereby the toner layer weight on a unit area of the toner-carrying member can be calculated from an increase in weight of the filter. At the same time, the electric charge accumulated in the inner cylinder electrostatically shielded from the outside is measured to provide an electric charge per unit area of the toner-carrying member. A characteristic feature of the magnetic toner used in the present invention is that it comprises 17–60% by number of particles below 5 microns. According to our study, magnetic toner particles of 5 microns or smaller is an essential component for stabilizing the volume-average particle size of the magnetic toner on the sleeve during successive image formation.

For example, when a magnetic toner having a particle size distribution ranging from 0.5 micron to 30 microns was used while changing the surface potential on a photosensitive member from a large developing potential contrast capable of developing a large number of toner particles, through a half tone potential, and to a small developing potential contrast capable of developing only a small portion of toner particles, and the developed toner particles on the photosensitive member was collected and subjected to measurement of toner particle size distribution, a large proportion of the magnetic toner particles was 8 microns or smaller, particularly 5 microns or smaller. In a successive image formation, a portion of the magnetic toner particles having a particle size of 5 microns or smaller most suitable for development is preferentially consumed, and if the portion is little in amount, the volume average particle size of the toner on the sleeve is gradually enlarged to provide a larger M/S value on the sleeve, so that the uniformization of sleeve coating is liable to be difficult. Accordingly, it is preferred that magnetic toner particles having a particle size of 5 microns or smaller occupy 17 to 60% by number of the total particles. Below 17% by number, the effect is small. In excess of 60% by number, the magnetic toner particles are liable to cause mutual aggregation, to form toner clogs having a particle size larger than their own particles thus resulting in coarse or rough images, poor resolution, a large difference in density between the edge portion and the inner portion of a latent image, and a dropout in an inner image portion to some extent.

The magnetic toner used in the present invention comprises 1 to 23% by number of the particles in the range of 8 to 12.7 microns. This is related with the developing performance of magnetic toner particles having a particle size of 5 microns or smaller. Magnetic toner particles having a size of 5 microns or smaller are capable cf strictly covering a latent image and providing a faithful reproduction but, in some cases where a latent image per se has an electric field intensity which is higher at the peripheral edge than at the central portion, it provides an apparently lower image density because the toner coverage becomes poorer in the internal portion than at the edge portion of the latent image. This tendency becomes pronounced particularly when magnetic toner particles of 5 microns or smaller are used.

However, we have found it possible to solve the problem by using a toner containing 1 to 23% by number of particles in the range of 8 to 12.7 microns provide clearer images. This is considered because the particles in the range of 8 to 12.7 microns have an appropriately controlled charge with respect to magnetic toner particles of 5 microns or smaller, whereby the portion of toner particles is supplied to an inner portion having a smaller electric field intensity than at the edge portion of the latent image to compensate for less coverage of toner particles in the inner portion compared with the edge portion. As a result, a sharp image having a high density as well as an excellent resolution and gradation may be provided.

Accordingly, it is preferred that the particles in the range of 8 to 12.7 microns occupy 1-23% by number. In excess of 23% by number, the image quality becomes worse and an excessive development (excessive coverage by toner) occurs to result in a increase in toner consumption. On the other hand, below 1% by number, it becomes difficult to obtain a high density image. Further, the particles of 5 micron or smaller may preferably satisfy the following relationship between their percentage by number (N) and percentage by volume (V):

$$N/V = -0.04N + k,$$

wherein $4.5 \leqq k \leqq 6.5$, and $17 \leqq N \leqq 60$.

During the examination of the particle size distribution of particles of 5 micron or smaller, we have found a state of presence of fine powder suitable for accomplishing the object as shown by the above formula. A large N/V value for a certain N value means that the toner contains particles having a size substantially below 5 microns, and a small N/V value means that the proportion of particles in the neighborhood of 5 microns is high and smaller particles are contained little. In the case where the N/V value is in the range of 2.1 to 5.82, the N value is in the range of 17 to 60 and the above-mentioned formula is satisfied; it is possible to further stabilize the volume-average particle size of the magnetic toner on the sleeve during successive image formation.

It is preferred that magnetic toner particles having a size of 16 microns or larger are restricted in amount to 2.0% by volume or below and preferably as little as possible.

In contrast with magnetic toner particles of 5 microns or smaller, magnetic toner particles of 16 microns or larger are not readily consumed relatively during successive image formation, and if the amount thereof exceeds 2.0% by volume, the volume-average particle size of the toner on the sleeve is gradually enlarged to increase the M/S value on the sleeve. This is not desirable.

The particle size distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1-3 minture by means of an ultrasonic disperser, and then subjected to measurement of particle size distribution in the range of 2-40 microns by using the above-mentioned Coulter counter Model TA-II with a 100 micron-aperture to obtain a volume-basis distribution and a number-basis distribution. From the results of the volume-basis distribution and number-basis distribution, the parameters characterizing the magnetic toner of the present invention may be obtained.

The binder for constituting the toner according to the present invention, when applied to a hot pressure roller fixing apparatus using an oil applicator, may be a known binder resin for toners. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl $\alpha$-chloromethacrylate copolymer, styrene-acrylonitrile copolymer, styrene-vinyl methyl rather copolymer, styrene-vinyl ethyl ether copolymer, styrene-vinyl methyl ketone copolymer, styrene-butadiene copolymer, styrene-isoprene copolymer, and styreneacrylonitrileindene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumarone-indene resin and petroleum resin.

In a hot pressure roller fixing system using substantially no oil application, serious problems are caused by an offset phenomenon that a part of toner image on toner image-supporting member is transferred to a roller, and also in respect of an intimate adhesion of a toner on the toner image-supporting member. As a toner fixable with less heat energy is generally liable to cause blocking or caking in storage or in a developing apparatus, this should be also taken into consideration. With these phenomena, the physical property of a binder resin in a toner is of most concern. According to our study, when the content of a magnetic material in a toner is decreased, the adhesion of the toner onto the toner image-supporting member mentioned above is improved, while the offset is more readily caused and also the blocking or caking are also more liable. Accordingly, when a hot roller fixing system using almost no oil application is adopted in the present invention, selection of a binder resin becomes more serious. A preferred binder resin may for example be a crosslinked styrene copolymer, or a crosslinked polyester. Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol diacrylate; divinyl compounds such as divinyl ether, divinyl sulfide and divinyl sulfone; and compounds having three or more vinyl groups, these compounds may be used singly or in mixture. In view of the fixability and anti-offset characteristic of the toner, the crosslinking agent may preferably be used in an amount of 0.01–10 wt. %, preferably 0.05–5 wt. %, based on the weight of the binder resin.

For a pressure-fixing system, a known binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyesters and paraffins.

In the magnetic toner cf the present invention, it is preferred that a charge controller may be incorporated in the toner particles (internal addition), or may be mixed with the toner particles (external addition). By using the charge controller, it is possible to most suitably control the charge amount corresponding to a developing system to be used. Particularly, in the present invention, it is possible to further stabilize the balance between the particle size distribution and the charge. As a result, when the charge controller is used in the present invention, it is possible to further clarify the above-mentioned functional separation and mutual compensation corresponding to the particle size ranges, in order to enhance the image quality.

Examples of the charge controller may include; nigrosine and its modification products modified by a fatty acid metal salt, quaternary ammonium salts, such as tributylbenzyl-ammonium-1 hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclo-hexyltin borate. These positive charge controllers may be used singly or as a mixture of two or more species. Among these, a nigrosine-type charge controller or a quaternary ammonium salt charge controller may particularly preferably be used.

As another type of positive charge controller, there may be used a homopolymer of a monomer having an amino group represents by the formula:

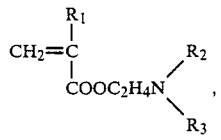

wherein $R_1$ represents H or $CH_3$; and $R_2$ and $R_3$ each represent a substituted or unsubstituted alkyl group (preferably $C_1$–$C_4$); or a copolymer of the monomer having an amine group with another polymerizable monomer such as styrene, acrylates, and methacrylates as described above. In this case, the positive charge controller also has a function of a binder.

On the other hand, a negative charge controller can be used in the present invention. Examples thereof may include an organic metal complex or a chelate compound. More specifically, there may preferably be used aluminum acethyl-acetonate, iron (II) acetylacetonate, and a 3,5-di-tertiary butylsalicylic acid chromium. There may more preferably be used acetylacetone complexes, or salicylic acid-type metal salts or complexes. Among these, salicylic acid-type complexes (inclusive of mono-alkyl-substituted compounds and di-alkyl-substituted compounds) or metal salts (inclusive of mono-alkyl-substituted compounds and di-alkyl-substituted compounds) may particularly preferably be used.

It is preferred that the above-mentioned charge controller is used in the form of fine powder. In such case, the number-average particle size thereof may preferably be 4 microns or smaller, more preferably 3 microns or smaller.

In the case of internal addition, such charge controller may preferably be used in an amount of 0.1–20 wt. parts, more preferably 0.2–10 wt. parts, per 100 wt. parts of a binder resin. An additive may be mixed internally or externally in the magnetic toner of the present invention as desired. More specifically, as a colorant, known dyes or pigments may be used generally in an amount of 0.5–20 wt. parts per 100 wt. parts of a binder resin. Another optional additive may be added to the toner so that the toner will exhibit further improved performances. Optional additives to be used include, for example, lubricants such as zinc stearate; abrasives such as cerium oxide and silicon carbide; flowability improvers such as colloidal silica and aluminum oxide; anti-caking agent; or conductivity-imparting agents such as carbon black and tin oxide.

In order to improve releasability in hot-roller fixing, it is also a preferred embodiment of the present invention to add to the magnetic toner a waxy material such as low-molecular weight polyethylene, low-molecular weight polypropylene, microcrystalline wax, carnauba wax, sasol wax or paraffin wax preferably in an amount of 0.5–5 wt. %.

The magnetic toner of the present invention contains a magnetic material. The magnetic material to be contained in the magnetic toner may be one or a mixture of: iron oxides such as magnetite, hematite, ferrite and ferrite containing excess iron; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These ferromagnetic materials may preferable be in the form of particles having an average particle size of the order of 0.1–1 micron, preferably 0.1–0.5 microns and be used in the &toner in an amount of about 60–120 wt. parts, particularly 65–110 wt. parts, per 100 wt. parts of a resin component (or per 100 wt. parts of a binder resin in a case where the magnetic toner does not contain a resin other than the binder resin).

The magnetic toner for developing electrostatic images according to the present invention may be produced by sufficiently mixing magnetic powder with a vinyl on non-vinyl thermoplastic resin such as those enumerated hereinbefore, and optionally, a pigment or dye as colorant, a charge controller, another additive, etc., by means of a mixer such as a ball mill, etc.; then melting and kneading the mixture by hot kneading means such as hot rollers, kneader and extruder to disperse or dissolve the pigment or dye, and optional additives, if any, in the melted resin; cooling and crushing the mixture; and subjecting the powder product to precise classification to form magnetic toner according to the present invention.

It is possible that silica fine powder is added internally or externally to the magnetic toner of the present invention. The external addition is preferred.

In the magnetic toner of the present invention having the above-mentioned particle size distribution characteristic, the specific surface area thereof becomes larger than that in the conventioned toner. In a case where the magnetic toner particles are caused to contact the surface of a cylindrical electroconductive non-magnetic sleeve containing magnetic field-generating means therein in order to triboelectrically charge them, the frequency of the contact between the toner particle surface and the sleeve is increased as compared that in the conventional magnetic toner, whereby the abrasion of the toner particle or the contamination of the sleeve is liable to occur. However, when the magnetic toner of the present invention is combined with the silica fine powder, the silica fine powder -s disposed between the toner particles and the sleeve surface, whereby the abrasion of the toner particle is remarkably reduced.

Thus, the life of the magnetic toner and the sleeve may be elongated and the chargeability may stably be retained. As a result, there can be provided a developer comprising a magnetic toner showing excellent characteristics in long-time use. Further, the magnetic toner particles having a particle size of 5 microns or smaller, which play an important role in the present invention, may produce a better effect in the presence of the silica fine powder, thereby to stably provide high-quality images.

The silica fine powder may be those produced through the dry process or the et process. A silica fine powder produced through the dry process is preferred in view of the anti-filming characteristic and durability thereof.

The dry process referred to herein is a process for producing silica fine powder through vapor-phase oxidation of a silicon halide. For example, silic powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

On the other hand, in order to produce silica powder to be used in the present invention through the wet process, various processes known heretofore may be applied. For example, decomposition of sodium silicate with an acid represented by the following scheme may be applied:

$$Na_2O.xSiO_2+HCl+H_2O \rightarrow SiO_2.nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica powder to be used herein may be anhydrous silicon dioxide (colloidal silica), and also a silicate such as aluminum silicate, sodium silicate, potassium silicate, magnesium silicate and zinc silicate.

Commercially available fine silica powders formed by the wet process include those sold under the trade names as shown below:

Carplex (available from Shionogi Seiyaku K.K.)
Nipsil (Nippon Silica K.K.)
Tokusil, Finesil (Tokuyama Soda K.K.)
Bitasil (Tagi Seihi K.K.)
Silton, Silnex (Mizusawa Kagaku K.K.)
Starsil (Kamishima Kagaku K.K.)
Himesil (Ehime Yakuhin K.K.)
Soloid (Fuki Devison Kagaku K.K.)
Hi-Sil (Pittsburgh Plate Glass Co.)
Durosil, Ultrasil (Fulstoff-Gesellschaft Marquart)
Manosil (Hardman and Holden)
Hoesch (Chemische Fabrik Hoesch K-G)
Sil-Stone (Stoner Rubber Co.)
Nalco (Nalco Chem. Co.)
Quso (Philadelphia Quartz Co.)
Imsil (Illinois Minerals Co.)
Calcium Silikat (Chemische Fabrik Hoesch, K-G)
Calsil (Fullstoff-Gesellschaft Marquart)
Fortafil (Imperial Chemical Industries)
Microcal (Joseph Crosfield & Sons. Ltd.)
Manosil (Hardman and Holden)
Vulkasil (Farbenfabriken Bayer, A.G.)
Tufknit (Durham Chemicals, Ltd.)
Silmos (Shiraishi Kogyo K.K.)
Starlex (Kamishima Kagaku K.K.)
Furikosil (Tagi Seihi K.K.)

Among the above-mentioned silica powders, those having a specific surface area as measured by the BET method with nitrogen adsorption of 30 $m^2/g$ or more, particularly 50–400 $m^2/g$, provide a good result.

In the present invention, the silica fine powder may preferably be used in an amount of 0.01–8 wt. parts, more preferably 0.1–5 wt. parts, with respect to 100 wt. parts of the magnetic toner.

In case where the magnetic toner of the present invention is used as a positively chargeable magnetic toner, it is preferred to use positively chargeable fine silica powder rather than negatively chargeable fine silica powder, in order to prevent the abrasion of the toner particles, and to retain the stability in chargeability.

In order to obtain positively chargeable silica fine powder, the above-mentioned silica powder obtained through the dry or wet process may be treated with a silicone oil having an organic groups containing at least one nitrogen atom in its side chain, a nitrogen-containing silane coupling agent, or both of these.

In the present invention, "positively chargeable silica" means one having a positive triboelectric charge with respect to iron powder carrier when measured by the blow-off method.

The silicone oil having a nitrogen atom in its side chain to be used in the treatment of silica fine powder may be a silicone oil having at least the following partial structure:

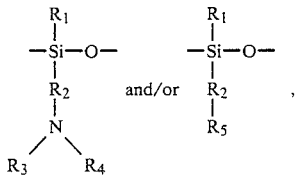

wherein $R_1$ denotes hydrogen, alkyl, aryl or alkoxyl; $R_2$ denote alkylene or phenylene; $R_3$ and $R_4$ denotes hydrogen, alkyl, or aryl; and $R_5$ denotes a nitrogen-containing heterocyclic group. The above alkyl, aryl, alkylene and phenylene group can contain an organic group having a nitrogen atom, or have a substituent such as halogen within an extent not impairing the chargeability. The above-mentioned silicone oil may preferably be used in an amount of 1–50 wt. %, more preferably 5–30 wt. %, based on the weight of the silica fine powder.

The nitrogen-containing silane coupling agent used in the present invention generally has a structure represented by the following formula:

$$R_mSiY_n,$$

wherein R is an alkoxy group or a halogen atom; Y is an amino group or an organic group having at least one amino group or nitrogen atom; and m and n are positive integers of 1–3 satisfying the relationship of $m+n=4$.

The organic group having at least one nitrogen group may for example be an amino group having an organic group as a substituent, a nitrogen-containing heterocyclic group, or a group having a nitrogen-containing heterocyclic group. The nitrogen-containing heterocyclic group may be unsaturated or saturated and may respectively be known ones. Examples of the unsaturated heterocyclic ring structure providing the nitrogen-containing heterocyclic group may include the following:

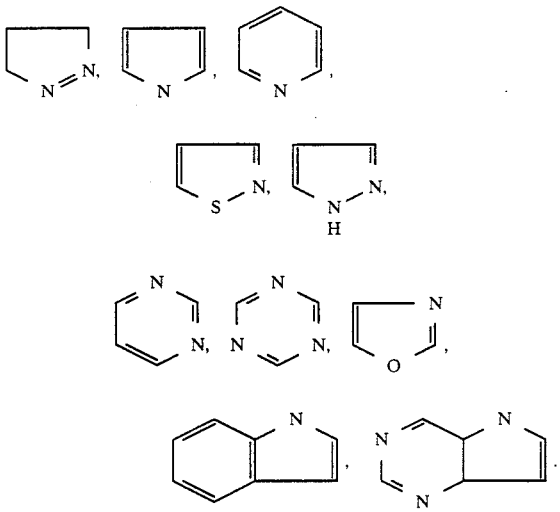

Examples of the saturated heterocyclic ring structure include the following:

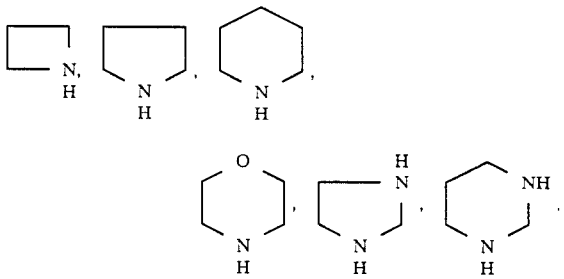

The heterocyclic groups used in the present invention may preferably be those of five-membered or six-membered rings in consideration of stability.

Examples of the silane coupling agent include:
aminopropyltrimethoxysilane,
aminopropyltriethoxysilane,
dimethylaminopropyltrimethoxysilane,
diethylaminopropyltrimethoxysilane,
dipropylaminopropyltrtimethoxysilane,
dibutylaminopropyltrimethoxysilane,
monobutylaminopropyltrimethoxysilane,
dioctylaminopropyltrimethoxysilane,
dibutylaminopropyldimethoxysilane,
dibutylaminopropylmonomethoxysilane,
dimethylaminophenyltriethoxysilane,
trimethoxysilyl-γ-propylphenylamine, and
trimethoxysilyl-γ-propylbenzyl-amine.

Further, examples of the nitrogen-containing heterocyclic compounds represented by the above structural formulas include:
trimethoxysilyl-γ-propylpiperidine,
trimethoxysilyl-γ-propylmorpholine, and
trimethoxysilyl-γ-propylimidazole.

The above-mentioned nitrogen-containing silane coupling agent may preferably be used in an amount of 1–50 wt. %, more preferably 5–30 wt. %, based on the weight of the silica fine powder.

The thus treated positively chargeable silica powder shows an effect when added in an amount of 0.01–8 wt. parts and more preferably may be used in an amount of 0.1–5 wt. parts, respectively with respect to the positively chargeable magnetic toner to show a positive chargeability with excellent stability. As a preferred mode of addition, the treated silica powder in an amount of 0.1–3 wt. parts with respect to 100 wt. parts of the positively chargeable magnetic toner should preferably be in the form of being attached to the surface of the toner particles. The above-mentioned untreated silica fine powder may be used in the same amount as mentioned above.

The silica fine powder used in the present invention may be treated as desired with another silane coupling agent or with an organic silicon compound for the purpose of enhancing hydrophobicity. The silica powder may be treated with such agents in a known manner so that they react with or are physically adsorbed by the silica powder. Examples of such treating agents include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroetyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds. The above-mentioned treating agent may preferably be used in an amount of 1–40 wt. % based on the weight of the silica fine powder. However, the above treating agent may be used so that the final product of the treated silica fine powder shows positive chargeability.

In the present invention, it is preferred to add fine powder of a fluorine-containing polymer such as polytetra-fluoroethylene, polyvinylidene fluoride, or tetrafluoroethylene-vinylidene fluoride copolymer. Among these, polyvinylidene fluoride fine powder is particularly preferred in view of fluidity and abrasiveness. Such powder of a fluorine-containing polymer may preferably be added to the toner in an wt.% amount of 0.01–2.0 wt. %, particularly 0.02–1.0 wt. %.

In a magnetic toner wherein the silica fine powder and the above-mentioned fluorine-containing fine powder are combined, while the reason is not necessarily clear, there occurs a phenomenon such that the state of the presence of the silica attached to the toner particle is stabilized and, for example, the attached silica is prevented from separating from the toner particle so that the effect thereof on toner abrasion and sleeve contamination is prevented from decreasing, and the stability in chargeability can further be enhanced.

FIG. 1 shows an example of a specific apparatus for practicing the developing step of the present invention. It is possible to effect design change within in the scope of the present invention.

Referring to FIG. 1, a developing apparatus 7 has a wall 7*a* in which a magnetic toner 10 is contained. In this embodiment a non-magnetic sleeve 2-1 may be used as an example of the toner-carrying member according to the present invention. In a further specific embodiment the sleeve 2-1 is one of stainless steel (SUS 304) having a diameter of 50 mm and having an uneven surface comprising a plurality of sphere-traced concavities. The sleeve contains inside therein a magnet 4 having magnetic poles $N_1=850$ Gauss, $N_2=500$ Gauss, $S_1=650$ Gauss and $S_2=500$ Gauss. A blade 1*a* as a toner layer thickness regulating means may be composed of iron which is a magnetic material. Between the blade 1*a* and the sleeve 2-1, a gap of 250 microns is formed, and a toner layer 3 of the toner 10 of the present invention is formed in a layer thickness of about 180 microns. A bias electric supply 11 as a biasing means provides an AC of Vpp=1200 V and a frequency F=800 Hz superposed with a DC=+100 V. A latent image-holding member 9 is disposed with a minimum distance of 300 microns from the sleeve 2-1.

Hereinbelow, the present invention is explained in more detail with reference to specific examples, which are however not intended to restrict the scope of the present invention in any way. In the examples, "parts" for describing compositional ratios are all by weight.

EXAMPLE 1

Inside an electrophotographic copier NP-3525 (mfd. by Canon K.K.) having basically a structure as shown in FIG. 1 and using a one-component magnetic toner, a cylindrical sleeve of stainless steel (SUS 304) containing a magnet therein was disposed. The surface of the sleeve was provided with a plurality of 10 sphere-traced concavities having a diameter R of 53 to 62 microns formed by blasting glass beads (substantially true spheres ere having a ratio of longer axis/shorter axis of almost 1.0) containing 80% by number or more of glass beads having a diameter of 53 to 62 microns from a blasting nozzle having a diameter of 7 microns and disposed 100 mm from the sleeve. The blasting occurred under an air pressure of 4 kg/cm$^2$ for 2 min. The sleeve surface had an unevenness pattern with a pitch P of 33 microns and a surface roughness d of 2.5 microns. The thus surface treated sleeve (called "sleeve A") was installed in the copier NP-3525. On the other hand, the magnetic toner 10 was one having the following composition.

| | |
|---|---|
| Styrene/butyl acrylate/divinyl benzene copolymer (copolymerization wt. ratio: 80/19.5/0.5, weight-average molecular weight: 320,000 | 100 wt. parts |
| Tri-iron tetraoxide (average particle size = 0.2 micron) | 80 wt. parts |
| Nigrosine (number-average particle size = about 3 microns) | 4 wt. parts |
| Low-molecular weight propylene-ethylene copolymer | 4 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfg. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain black fine powder (magnetic toner) having a volume-average particle size of 7.8 microns. When the triboelectric charge of the thus obtained black fine powder was measured by mixing with iron powder carrier, it showed a value of +8 μC/g.

The number-basis distribution and volume-basis distribution of the thus obtained magnetic toner of positively chargeable black fine powder were measured by means of a Coulter counter Model TA-II with a 100 micron-aperture in the above-described manner. The results are shown in the following Table 1.

TABLE 1

| Size (μm) | Number of particles | % by number (N) Distribution | % by number (N) Accumulation | % volume (V) Distribution | % volume (V) Accumulation |
|---|---|---|---|---|---|
| 2.00–2.52 | 1213 | 1.3 | 1.3 | 0 | 0 |
| 2.52–3.17 | 2521 | 2.8 | 4.1 | 0 | 0 |
| 3.17–4.00 | 8082 | 8.8 | 12.9 | 1.6 | 1.6 |
| 4.00–5.04 | 21612 | 23.7 | 36.6 | 9.2 | 10.8 |
| 5.04–6.35 | 23724 | 26.0 | 62.6 | 18.6 | 29.4 |
| 6.35–8.00 | 18950 | 20.8 | 83.3 | 27.2 | 56.6 |
| 8.00–10.08 | 11577 | 12.7 | 96.0 | 27.3 | 83.8 |
| 10.08–12.70 | 3420 | 3.7 | 99.8 | 14.4 | 98.3 |
| 12.70–16.00 | 223 | 0.2 | 100.0 | 1.7 | 100.0 |
| 16.00–20.20 | 3 | 0.0 | 100.0 | 0.0 | 100.0 |
| 20.20–25.40 | 0 | 0.0 | 100.0 | 0.0 | 0.0 |
| 25.40–32.00 | 0 | 0.0 | 100.0 | 0.0 | 0.0 |
| 32.00–40.30 | 0 | 0.0 | 100.0 | 0.0 | 0.0 |
| 40.30–50.80 | 0 | 0.0 | 100.0 | 0.0 | 0.0 |

A 0.5 wt. part of positively chargeable hydrophobic dry process silica (BET specific surface area: 200 m$^2$/g) was added to 100 wt. parts of the positively chargeable insulating magnetic toner of black fine powder obtained above and mixed together by means of a Henschel mixer thereby to obtain a silica-added magnetic toner (hereinafter called a "toner A"). The toner A showed a particle size distribution as shown in Table 2.

The toner A was charged in the electrophotographic copier NP-3525 equipped with the above-mentioned sleeve A to effect an image formation test. The image formation test was continued for 5000 times and the results are shown in Table 3 appearing hereinafter together with those of other Examples and Comparative Examples. As is clear from Table 3, the toner layer weight M/S per unit area of the sleeve showed an appropriate value of 1.1 mg/cm$^2$ in the initial stage and was stably retained at 1.1 mg/cm$^2$ even after the continuous image formation of 5000 sheets, and the toner coating on the sleeve was extremely uniform. The sleeve surface after the 5000 sheets of continuous operation was cleaned by air and observed through a scanning electron microscope, whereby no attachment of toner component at the surface concavities was observed and substantially no soiling of the sleeve was observed. As a result, clear and high quality images having a high image density $D_{max}$ and free from fog were formed at the initial stage as well as after the 5000 sheets of continuous image formation.

Further, a 0.5 wt. part of a positively chargeable hydrophobic dry process silica and a 0.2 wt. part of polyvinylidene fluoride fine powder were blended with 100 wt. parts of the above-mentioned positively chargeable insulating magnetic toner to prepare an externally added toner composition and a similar image formation test was performed, whereby good results were obtained. In a successive image formation test for a large number of sheets, the toner externally added with the polyvinylidene fluoride and silica fine powder showed a better result compared with the toner externally added with only the silica fine powder.

COMPARATIVE EXAMPLE 1

A sleeve was prepared in the same manner as in Example 1 except that the sleeve surface was not subjected to blasting with definite-shaped particles but abraded with cerium oxide fine powder as an abrasive to form a smooth mirror-finished state. The thus obtained sleeve (sleeve B) was used instead of the sleeve A used in Example 1, and otherwise similarly as in Example 1, the evaluation was performed.

At the initial stage, clear images having a high density and free of fog were obtained but the M/S value on the sleeve was as large as 1.9 mg/cm$^2$. After 5000 sheets of image formation, toner coating irregularities occurred on the sleeve from both sides thereof, and the resultant images were accompanied with a lack of images on both sides and irregular fog. The M/S value on the sleeve was as high as 2.4 mg/cm$^2$ because the toner coating irregular portions were present.

COMPARATIVE EXAMPLE 2

A sleeve C was prepared in the same manner as in Example 1 except that indefinite-shaped particles of #300 Carborundum were used instead of the glass beads for surface treating of the sleeve. The same evaluation as in Example 1 was performed except that the sleeve C was used instead of the sleeve A used in Example 1.

At the initial stage, clear images having a high density and free from fog were obtained, but after 5000 sheets of the image formation, the resultant images had a remarkable decrease in image density to a value of 0.68. The sleeve after the successive image formation was sweeped by air and observed through a scanning electron microscope, whereby a large amount of toner component was found to attach to the sleeve surface to show the soiling of the sleeve.

EXAMPLES 2-7

Magnetic toners B to G having various volume-average particle sizes and particle size distributions shown in Table 2 were prepared in the same manner as in Example 1. The same evaluation as in Example 1 was performed except that the toner A was replaced respectively by the toners B to G and the image formation was performed under the conditions of a temperature of 10° C. and humidity of 15%. As is clear from the results shown in Table 3, the resultant images both at the initial stage and after the 5000 sheets of successive image formation showed a high image density, and were free from fog, clear and of high qualities. No soiling or toner coating irregularities on the sleeve were observed.

COMPARATIVE EXAMPLES 3-6

Magnetic toners H-K having various volume-average particle sizes and particle size distributions shown in Table 2 were prepared in the same manner as in Example 1. The same evaluation as in Example 1 was performed except that the toner A used in Example 1 was respectively replaced by the toners H to K and the image formation was performed under the conditions of a temperature of 10° C. and a humidity of 15%. The results are shown in Table 3. In Comparative Example 3 using the toner H, the images obtained at the initial stage and also after 5000 sheets of successive image formation showed a low image density and were far from being satisfactory.

In Comparative Examples 4-6 using the toners, I-K, the images at the initial stage were good, but after the 5000 sheets of successive image formation, the toner coating on the sleeve was accompanied with partial irregularity, and at the corresponding portions of the resultant images, lack of images and irregular fog were observed.

The results in the above Examples and Comparative Examples are summarized in the following Tables 2 and Table 3.

TABLE 2

| | Particle size distribution of toner | | | | |
|---|---|---|---|---|---|
| Toner | % by number of particles of ≦5 μm | % by volume of particles of ≧16 μm | % by number of particles of 8-12.7 μm | Volume-average particle size (μm) | (% by number)/(% by volume) of particles of ≦5 μm |
| Present invention | | | | | |
| A | 35 | 0.0 | 14 | 7.8 | 3.4 |
| B | 57 | 0.2 | 10 | 4.9 | 2.4 |
| C | 46 | 0.3 | 11 | 6.5 | 3.4 |
| D | 40 | 0.7 | 12 | 7.4 | 3.9 |
| E | 35 | 1.0 | 14 | 8.5 | 3.5 |
| F | 27 | 1.5 | 18 | 9.7 | 3.6 |
| G | 20 | 1.7 | 23 | 10.2 | 5.0 |
| Comp. Example | | | | | |
| H | 72 | 0.0 | 10 | 3.8 | 1.8 |
| I | 10 | 6.7 | 49 | 12.7 | 6.1 |
| J | 12 | 1.9 | 52 | 10.2 | 3.5 |
| K | 35 | 4.3 | 45 | 10.6 | 4.9 |

TABLE 3

| | | | | | After 5000 sheets of image formation | | | | |
|---|---|---|---|---|---|---|---|---|---|
| | | | Initial stage | | | | | | |
| | Sleeve | Toner | Dmax | M/S (mg/cm$^2$) | Dmax | M/S | Volume-ave. particle size of toner on sleeve (μ) | Sleeve soiling | Toner coating irregularities |
| Ex. 1 | A | A | 1.30 | 1.1 | 1.38 | 1.1 | 7.8 | None | o |
| Comp. Ex. | | | | | | | | | |
| 1 | B | A | 1.38 | 1.9 | 1.30 | 2.4 | 7.8 | None | x |
| 2 | C | A | 1.33 | 1.0 | 0.68 | 0.7 | 7.4 | Extensive | o |
| Ex. | | | | | | | | | |
| 2 | A | B | 1.32 | 0.8 | 1.36 | 0.9 | 5.3 | None | o |
| 3 | A | C | 1.34 | 1.0 | 1.37 | 1.0 | 6.7 | " | o |
| 4 | A | D | 1.31 | 1.0 | 1.33 | 1.1 | 7.5 | " | o |
| 5 | A | E | 1.38 | 1.1 | 1.40 | 1.2 | 8.4 | " | o |
| 6 | A | F | 1.38 | 1.2 | 1.34 | 1.2 | 9.8 | " | o |

TABLE 3-continued

| | | | Initial stage | | After 5000 sheets of image formation | | | | |
|---|---|---|---|---|---|---|---|---|---|
| | Sleeve | Toner | Dmax | M/S (mg/cm²) | Dmax | M/S | Volume-ave. particle size of toner on sleeve (μ) | Sleeve soiling | Toner coating irregularities |
| 7 | A | G | 1.34 | 1.3 | 1.40 | 1.3 | 10.1 | " | o |
| Comp. Ex. | | | | | | | | | |
| 3 | A | H | 1.09 | 0.8 | 1.10 | 0.7 | 3.9 | None | o |
| 4 | A | I | 1.36 | 1.5 | 1.28 | 2.1 | 13.5 | " | x |
| 5 | A | J | 1.33 | 1.3 | 1.27 | 2.0 | 12.8 | " | x |
| 6 | A | K | 1.32 | 1.3 | 1.24 | 1.9 | 13.1 | " | x |

EXAMPLES 8, 9

Sleeves D and E were prepared in the same manner as in Example 1 except that the glass beads having a diameter of 53–62 microns used in Example 1 were replaced by glass beads (substantially true spheres) containing 80% by number or more of glass beads having a diameter of 44–53 microns and glass beads containing 80% by number or more of glass beads having a particle size of 149–177 microns, respectively, for the surface treating of the sleeve. The parameters of the sleeves are shown in Table 4 appearing hereinafter. The same evaluation as in Example 1 was performed by using the sleeves D and E respectively. The results are shown in Table 5 appearing hereinafter together with those of the other Examples.

As is understood from Table 5, the images both at the initial stage and after the 5000 sheets of successive image formation, showed a high image density, and were free from fog, clear and of a high quality. No sleeve soiling was observed either.

EXAMPLE 10

A sleeve F was prepared in the same manner as in Example 1 except that the glass beads having a diameter of 53–62 microns used in Example 1 were replaced by glass beads (substantially true spheres) containing 80% by number or more of glass beads having a diameter of 250–350 microns for the surface treating of the sleeve. The parameters of the sleeve are shown in Table 4. The same evaluation as in Example 1 was performed by using the sleeve F. The results are shown in Table 5.

At the initial stage of image formation, clear images having a high density and free from fog were obtained. After 5000 sheets of successive image formation, slight fog was observed, but otherwise good results were obtained.

EXAMPLE 11

A sleeve G was prepared in the same manner in Example 9 except that the sleeve surface treatment was conducted by changing the distance of the blasting nozzle from 100 mm to 200 mm. The parameter of the sleeve G are shown in Table 4. The same evaluation as in Example 9 was performed by using the sleeve G instead of the sleeve E. The results are also shown in Table 5.

At the initial stage of image formation, clear images having a high density and free from fog were obtained. After 5000 sheets of successive image formation, slight fog was observed, but otherwise good results were obtained.

EXAMPLE 12

A sleeve H was prepared in the same manner in Example 10 except that the sleeve surface treatment was conducted by changing the distance of the blasting nozzle from 100 mm to 200 mm. The parameter of the sleeve H are shown in Table 4. The same evaluation as in Example 10 was performed by using the sleeve H instead of the sleeve F. The results are also shown in Table 5.

Both the initial stage and after 5000 sheets of successive image formation, slight fog was observed, but otherwise good clear images having a high density were obtained.

TABLE 4

| | Sleeve | Diameter of sphere-treated concavities R | Unevenness pitch P | Surface roughness d |
|---|---|---|---|---|
| Example | | | | |
| 1 | A | 53–62 μm | 33 μm | 2.0 μm |
| 8 | D | 44–53 | 39 | 2.4 |
| 9 | E | 149–177 | 52 | 2.2 |
| 10 | F | 250–350 | 79 | 1.9 |
| 11 | G | 149–177 | 105 | 1.5 |
| 12 | H | 250–350 | 110 | 1.4 |

TABLE 5

| | | | | Initial stage | | After 5000 sheets of image formation | | | | |
|---|---|---|---|---|---|---|---|---|---|---|
| | Sleeve | Toner | Dmax | M/S (mg/cm²) | Dmax | M/S | Volume-ave. particle size of toner on sleeve (μ) | Sleeve soiling | Toner coating irregularities |
| Ex. 1 | A | A | 1.30 | 1.1 | 1.38 | 1.1 | 7.8 | None | o |
| 8 | D | A | 1.29 | 1.0 | 1.39 | 1.1 | 7.9 | None | o |
| 9 | E | A | 1.32 | 1.2 | 1.40 | 1.2 | 7.8 | None | o |

TABLE 5-continued

| | | | Initial stage | | After 5000 sheets of image formation | | | | |
|---|---|---|---|---|---|---|---|---|---|
| | Sleeve | Toner | Dmax | M/S (mg/cm²) | Dmax | M/S | Volume-ave. particle size of toner on sleeve (μ) | Sleeve soiling | Toner coating irregularities |
| 10 | F | A | 1.31 | 1.3 | 1.43 | 1.4 | 8.1 | None | o |
| 11 | G | A | 1.31 | 1.2 | 1.44 | 1.4 | 8.0 | None | o |
| 12 | H | A | 1.35 | 1.5 | 1.43 | 1.5 | 8.1 | None | o |

What is claimed is:

1. An image forming apparatus, comprising:

an electrostatic image-bearing member for holding an electrostatic charge image-bearing member for holding an surface for carrying a magnetic toner thereon, wherein the surface of the toner-carrying member has an unevenness comprising sphere-traced concavities formed by blasting with particles with a definite spherical shape and has a surface roughness d of 0.1 to 5 microns;

the magnetic toner comprises 17–60% by number of particles of 5 microns or smaller, 1–23% by number of particles of 8–12.7 microns, and 2.0% by volume or less of particles of 16 microns or larger and has a volume-average particle size of 4–11 microns;

the electrostatic image-bearing member and the toner-carrying member are disposed with a prescribed gap therebetween at a developing station;

means for forming a magnetic toner layer on the toner-carrying member in a thickness which is thinner than the prescribed gap; and means for applying an alternating electric field for development with the magnetic toner at the developing station.

2. An image forming apparatus according to claim 1, wherein the toner-carrying member has sphere-traced concavities having a diameter of 20–250 microns on the surface.

3. An image forming apparatus according to claim 2, wherein the toner-carrying member has sphere-traced concavities on the entire surface for carrying the toner.

4. An image forming apparatus according to claim 3, wherein the toner-carrying member has the sphere-traced concavities so as to provide a surface unevenness pitch P of 2 to 100 microns on the surface.

5. An image forming apparatus according to claim 1, wherein the sphere-traced concavities on the toner-carrying member have been formed by blasting of solid spheres.

6. An image forming apparatus according to claim 5, wherein the sphere-traced concavities on the toner-carrying member have been formed by blasting of definite-shaped particles containing 80% by number or more of glass beads having a diameter of 53 to 62 microns.

7. An image forming apparatus according to claim 1, wherein the magnetic toner has a volume-average particle size of 6 to 10 microns.

8. An image forming apparatus according to claim 1, wherein the magnetic toner has a particle size distribution satisfying the following formula:

$$N/V = -0.04N + k,$$

wherein N denotes the value of % by number of magnetic particles having a size of 5 microns or smaller, V denotes the value of % by volume of magnetic particles having a size of 5 microns or smaller, k is a positive number of from 4.5 to 6.5, and the N is a positive number of 17 to 60.

9. An image forming apparatus according to claim 1, wherein the magnetic toner contains a charge controller.

10. An image forming apparatus according to claim 9, wherein the magnetic toner contains a nigrosine compound or an organic quaternary ammonium salt as the charge controller.

11. An image forming apparatus according to claim 9, wherein the magnetic toner contains an organic metal complex or an organic metal salt as the charge Controller.

12. An image forming apparatus according to claim 11, wherein the magnetic toner contains a salicylic acid-type metal salt or a salicylic acid-type metal complex.

13. An image forming apparatus according to claim 1, wherein the magnetic toner contains 0.5 to 5 wt. % of a wax based on the binder resin.

14. An image forming apparatus according to claim 1, wherein the magnetic toner comprises 60–120 wt. parts of a magnetic material per 100 wt. parts of a resinous component.

15. An image forming apparatus according to claim 14, wherein the magnetic material has an average particle size of 0.1 to 1 micron.

16. An image forming apparatus according to claim 1, wherein the magnetic toner is triboelectrically charged by contact with the surface of the toner-carrying member.

17. An image forming apparatus according to claim 16, wherein the toner-carrying member is a cylindrical electroconductive sleeve containing a magnetic field generating means inside thereof, and the magnetic field generating means and the electroconductive sleeve are relatively moved.

18. An image forming apparatus according to claim 1, wherein 100 wt. parts of the magnetic toner is mixed with 0.01 to 8 wt. parts of a silica fine powder.

19. An image forming apparatus according to claim 18, wherein 100 wt. parts of the magnetic toner is mixed with 0.01 to 5 wt. parts of the silica fine powder.

20. An image forming apparatus according to claim 18, wherein the magnetic toner is a positively chargeable magnetic toner, and the silica fine powder comprises a positively chargeable hydrophobic silica fine powder treated with a silicone oil having a nitrogen atom in its side chain.

21. An image forming apparatus according to claim 1, wherein the magnetic toner is mixed with a silica fine powder and a fluorine-containing polymer fine powder.

22. An image forming apparatus according to claim 1, wherein the toner-carrying member comprises an electroconductive sleeve of stainless steel.

23. An image forming method, comprising:

deposing an electrostatic image-bearing member for holding an electrostatic charge image and a toner-carrying member for carrying a magnetic toner with a prescribed gap therebetween at a developing station, wherein the surface of the toner-carrying member has an unevenness comprising sphere-traced concavities formed by blasting with particles with a definite spherical shape and has a surface roughness d of 0.1 to 5 microns;

the magnetic toner comprises 17–60% by number of particles of 5 microns or smaller, 1–23% by number of particles of 8–12.7 microns, and 2.0% by volume or less of particles of 16 microns or larger and has a volume-average particle size of 4–11 microns;

conveying the magnetic toner in a layer regulated in a thickness thinner than the prescribed gap to the developing station; and applying an alternating electric field to the toner-carrying member at the developing station to effect development with the magnetic toner.

24. An image forming method according to claim 23, wherein the toner-carrying member has sphere-traced concavities having a diameter of 20–250 microns on the surface.

25. An image forming method according to claim 24, the toner-carrying member has sphere-traced concavities on the entire surface for carrying the toner.

26. An image forming method according to claim 25, wherein the toner-carrying member has the sphere-traced concavities so as to provide a surface unevenness pitch P of 2 to 100 microns on the surface.

27. An image forming method according to claim 24, wherein the sphere-traced concavities on the toner-carrying member have been formed by blasting of solid spheres.

28. An image forming method according to claim 27, wherein the sphere-traced concavities on the toner-carrying member have been formed by blasting of definite-shaped particles containing 80% by number or more of glass beads having a diameter of 53 to 62 microns.

29. An image forming method according to claim 23, wherein the magnetic toner has a volume-average particle size of 6 to 10 microns.

30. An image forming method according to claim 23, wherein the magnetic toner has a particle size distribution satisfying the following formula:

$$N/V = -0.04N + k,$$

wherein N denotes the value of % by number of magnetic particles having a size of 5 microns or smaller, V denotes the value of % by volume of magnetic particles having a size of 5 microns or smaller, k is a positive number of from 4.5 to 6.5, and the N is a positive number of 17 to 60.

31. An image forming method according to claim 23, wherein the magnetic toner contains a charge controller.

32. An image forming method according to claim 31, wherein the magnetic toner contains a nigrosine compound or an organic quaternary ammonium salt as the charge controller.

33. An image forming method according to claim 31, wherein the magnetic toner contains an organic metal complex or an organic metal salt as the charge controller.

34. An image forming method according to claim 33, wherein the magnetic toner contains a salicylic acid-type metal salt or a salicylic acid type metal complex.

35. An image forming method according to claim 23, wherein the magnetic toner contains 0.5 to 5 wt. % of a wax based on the binder resin.

36. An image forming method according to claim 23, wherein the magnetic toner comprises 60–120 wt. parts of a magnetic material per 100 wt. parts of a resinous component.

37. An image forming method according to claim 36, wherein the magnetic material has an average particle size of 0.1 to 1 micron.

38. An image forming method according to claim 23, the magnetic toner is triboelectrically charged by contact with the surface of the toner-carrying member.

39. An image forming method according to claim 38, wherein the toner-carrying member is a cylindrical electroconductive sleeve containing a magnetic field generating means inside thereof, and the magnetic field generating means and the electroconductive sleeve are relatively moved.

40. An image forming method according to claim 23, wherein 100 wt. parts of the magnetic toner is mixed with 0.01 to 8 wt. parts of a silica fine powder.

41. An image forming method according to claim 40, wherein 100 wt. parts of the magnetic toner is mixed with 0.01 to 5 wt. parts of the silica fine powder.

42. An image forming method according to claim 40, wherein the magnetic toner is a positively chargeable magnetic toner, and the silica fine powder comprises a positively chargeable hydrophobic silica fine powder treated with a silicone oil having a nitrogen atom in its side chain.

43. An image forming method according to claim 23, wherein the magnetic toner is mixed with a silica fine powder and a fluorine-containing polymer fine powder.

44. An image forming method according to claim 23, wherein the magnetic toner having a triboelectric charge is reciprocally moved between the electrostatic image-bearing member and the toner-carrying member to develop the electrostatic image in a magnetic field and under the action of an alternating electric field formed by superposition of AC bias and DC bias.

45. An image forming method according to claim 23, wherein the magnetic toner is triboelectrically charged by Contact with the surface of a toner-carrying member of stainless steel.

* * * * *

UNITED STATES PATENT AND TRADEMARK OFFICE

CERTIFICATE OF CORRECTION

PATENT NO. : 4,978,597

DATED : TOSHIAKI NAKAHARA ET AL.

INVENTOR(S) : December 18, 1990

It is certified that error appears in the above-identified patent and that said Letters Patent is hereby corrected as shown below: On the title page:

AT [75] INVENTORS

"Toshiaki Nakahara, Tokyo; Hirohide Tanikawa, Yokohama, both of Japan" should read --Toshiaki Nakahara, Tokyo; Hirohide Tanikawa, Yokohama; Satoshi Yoshida, Kawasaki; Kiichiro Sakashita, Tokyo, all of Japan--.

AT [57] ABSTRACT

Line 8, "comprisaes" should read --comprises--.

COLUMN 1

Line 39, "the" should read --along the--

COLUMN 2

Line 25, "white" should read --while--.
Line 45, "article" should read --particle--.

COLUMN 3

Line 51, "and 16 microns or larger and" should be deleted.
Line 52, "has" should read --16 microns or larger and has--.

COLUMN 4

Line 64, "mode" should read --made--.
Line 65, "ceramic" should read --ceramic,--.

UNITED STATES PATENT AND TRADEMARK OFFICE

CERTIFICATE OF CORRECTION

PATENT NO. : 4,978,597

DATED : TOSHIAKI NAKAHARA ET AL.

INVENTOR(S) : December 18, 1990

It is certified that error appears in the above-identified patent and that said Letters Patent is hereby corrected as shown below:

COLUMN 5

Line 29, "drawn" should read --drawn,--.

COLUMN 6

Line 29, "or" should read --for--.
Line 59, "is" should read --are--.

COLUMN 7

Line 4, "was" should read --were--.
Line 32, "cf" should read --of--.
Line 44, "provide" should read --to provide--.
Line 60, "a" should read --an--.
Line 63, "micron" should read --microns--.

COLUMN 8

Line 2, "micron" should read --microns--.
Line 45, "minture" should read --minutes--.
Line 65, "rather" should read --ether--.

COLUMN 9

Line 55, "groups, these" should read --groups. These--.
Line 67, "cf" should read --of--.

COLUMN 10

Line 28, "represents" should read --represented--.

UNITED STATES PATENT AND TRADEMARK OFFICE

CERTIFICATE OF CORRECTION

PATENT NO. : 4,978,597

DATED : TOSHIAKI NAKAHARA ET AL.

INVENTOR(S) : December 18, 1990

It is certified that error appears in the above-identified patent and that said Letters Patent is hereby corrected as shown below:

COLUMN 11

Line 26, "preferable" should read --preferably--.
Line 29, "&toner" should read --toner--.
Line 55, "conventioned" should read --conventional--.
Line 61, "that" should read --to that--.
Line 66, "-s" should read --is--.

COLUMN 12

Line 12, "et" should read --wet--.
Line 18, "silic" should read --silica--.

COLUMN 14

Line 12, "denote" should read --denotes-- and
"denotes" should read --denote--.

COLUMN 16

Line 21, "wt.%" should be deleted.
Line 35, "in" should be deleted.

COLUMN 17

Line 3, "10" should be deleted.
Line 6, "ere" should be deleted.

UNITED STATES PATENT AND TRADEMARK OFFICE

CERTIFICATE OF CORRECTION

PATENT NO. : 4,978,597

DATED : TOSHIAKI NAKAHARA ET AL.

INVENTOR(S) : December 18, 1990

It is certified that error appears in the above-identified patent and that said Letters Patent is hereby corrected as shown below:

COLUMN 20

Line 24, "toners," should read --toners--.
Line 33, "Table" should be deleted.

COLUMN 22

Line 24, "parameter" should read --parameters--.
Line 39, "parameter" should read --parameters--.

COLUMN 23

Line 16, "image-bearing member for" should read --image and a toner-carrying member having a--.
Line 17, "holding an" should be deleted.

COLUMN 24

Line 23, "Control-" should read --control---.
Line 67, "deposing" should read --disposing--.

COLUMN 25

Line 15, "and applying" should read --and ¶ applying--.
Line 25, "the" should read --wherein the--.
Line 31, "claim 24," should read --claim 23,--.

UNITED STATES PATENT AND TRADEMARK OFFICE

CERTIFICATE OF CORRECTION

PATENT NO. : 4,978,597

DATED : TOSHIAKI NAKAHARA ET AL.

INVENTOR(S) : December 18, 1990

It is certified that error appears in the above-identified patent and that said Letters Patent is hereby corrected as shown below:

COLUMN 26

Line 23, "the" should read --wherein the--.
Line 56, "Contact" should read --contact--.

Signed and Sealed this

Twenty-second Day of October, 1991

*Attest:*

HARRY F. MANBECK, JR.

*Attesting Officer*

*Commissioner of Patents and Trademarks*